US005453036A

United States Patent [19]

Wisznia

[11] Patent Number: 5,453,036

[45] Date of Patent: Sep. 26, 1995

[54] GLOW SPINNER

[76] Inventor: Pascal C. Wisznia, 2039 N. Meridian Rd. #252, Tallahassee, Fla. 32303

[21] Appl. No.: 262,781

[22] Filed: Jun. 20, 1994

Related U.S. Application Data

[63] Continuation-in-part of Ser. No. 123,787, Sep. 20, 1993, abandoned.

[51] Int. Cl.[6] ..... A63H 33/22; A63H 1/22

[52] U.S. Cl. ..... 446/219; 446/244; 446/245

[58] Field of Search ..... 446/219, 236, 446/242, 243, 244, 245, 256, 264, 265

[56] References Cited

U.S. PATENT DOCUMENTS

| | | | |
|---|---|---|---|
| 162,100 | 2/1951 | Wee | 446/256 X |
| 212,956 | 12/1968 | Lohr | 446/256 X |
| 1,319,123 | 10/1919 | Simon | 446/219 |
| 1,321,035 | 11/1919 | Harlan | 446/243 X |
| 2,809,833 | 10/1957 | Slade | 446/243 X |
| 3,550,317 | 12/1970 | Brown | 446/243 |
| 5,324,226 | 6/1994 | McKay et al. | 446/236 X |

FOREIGN PATENT DOCUMENTS

| | | | |
|---|---|---|---|
| 5953346 | 4/1934 | Germany | 446/256 |
| 8488 | of 1894 | United Kingdom | 446/245 |
| 9410 | of 1898 | United Kingdom | 446/243 |
| 2746 | 12/1915 | United Kingdom | 446/243 |

*Primary Examiner*—Robert A. Hafer
*Assistant Examiner*—D. Neal Muir

[57] ABSTRACT

A one piece spinning toy with markings made of either luminous or florescent material. When the toy is spun, it spins at an angle rather than upright, which creates a wobbling effect that causes the markings to generate a clear three-dimensional pattern.

10 Claims, 3 Drawing Sheets

GLOW SPINNER

This application is a continuation in part of previously filed Ser. No. 123,787, filed Sep. 20, 1993. This invention relates to the field of toys, specifically to three-dimensional illusional toys.

BACKGROUND

1. Prior Art

Spinning toys have always been very popular, and many styles have been designed for entertainment purposes. For example, Pat. No. 212,956 to Lohr (1968), depicted an ornamental spinner that spun at a 90 degree angle within a stand. Even at the turn of the twentieth century, spinners were designed having areas of luminous patterns that created a ring when spun, such as Pat. No. 1,319,123 to Simon (1919). Simon placed a disk that was decorated with a luminescent substance around a spindle, that when spun at a 90 degree angle, created a continuous luminous ring.

Although these are examples of spinning toys, they are deficient as comparison for the following reasons:

a. the present invention consists of one basic piece, whether constructed of one piece being either hollow or solid, whether assembled of several pieces that have been put together to produce one basic piece;

b. the present invention does not spin at a 90 degree angle, rather it spins at different angles, creating a wobbling effect; and c. the present invention, when spun, creates clear, three-dimensional pictures due to various patterns placed on it.

OBJECTS AND ADVANTAGES

Several objects and advantages are:

a. to provide a toy that is uniquely shaped that, when spun, creates a three-dimensional optical illusion;

b. to provide a toy that is not spun at a 90 degree angle, but rather spins at various angles, causing a wobbling effect;

c. to provide a toy with strategically placed luminescent markings that, when spun, will create three-dimensional graphic designs when viewed in darkness;

d. to provide a toy which can be brightly colored with florescent patterns to create graphic designs which can be viewed when spun;

Further objects and advantages are to provide a toy which can be used easily and with very little skill, a toy which provides an uniquely entertaining optical illusion and which is simple and inexpensive to manufacture. Still further objects and advantages will become apparent from a consideration of the ensuing description and drawings.

SUMMARY OF INVENTION

The present invention consists of one basic piece, a rod or tube, having at least one rounded end, which may either be constructed as such or may be assembled to create such. This basic piece may be either hollow or solid. This invention may be made of any suitable plastic, wood, metal, wax, or any other lightweight smooth material. This invention employs the use of strategically placed patterns, being made of a luminous or florescent substance that may be embedded or placed on the piece. When correctly operated, this invention does not spin upright, but rather at an angle on its rounded end. The effect created by this invention is a three-dimensional optical illusion when it is spun.

DRAWING FIGURES

DESCRIPTION OF PREFERRED EMBODIMENT

Figure 1A:
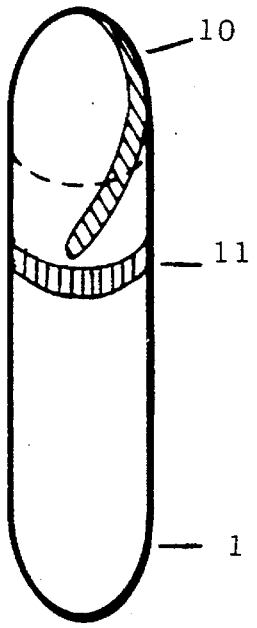
FIG. 1A shows a frontal view of spinner with strategically placed markings.
Figure 1B:
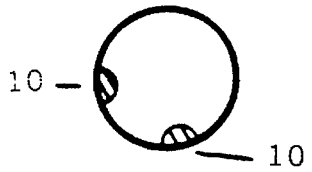
FIG. 1B shows a cross-sectional view of spinner.
Figure 2:
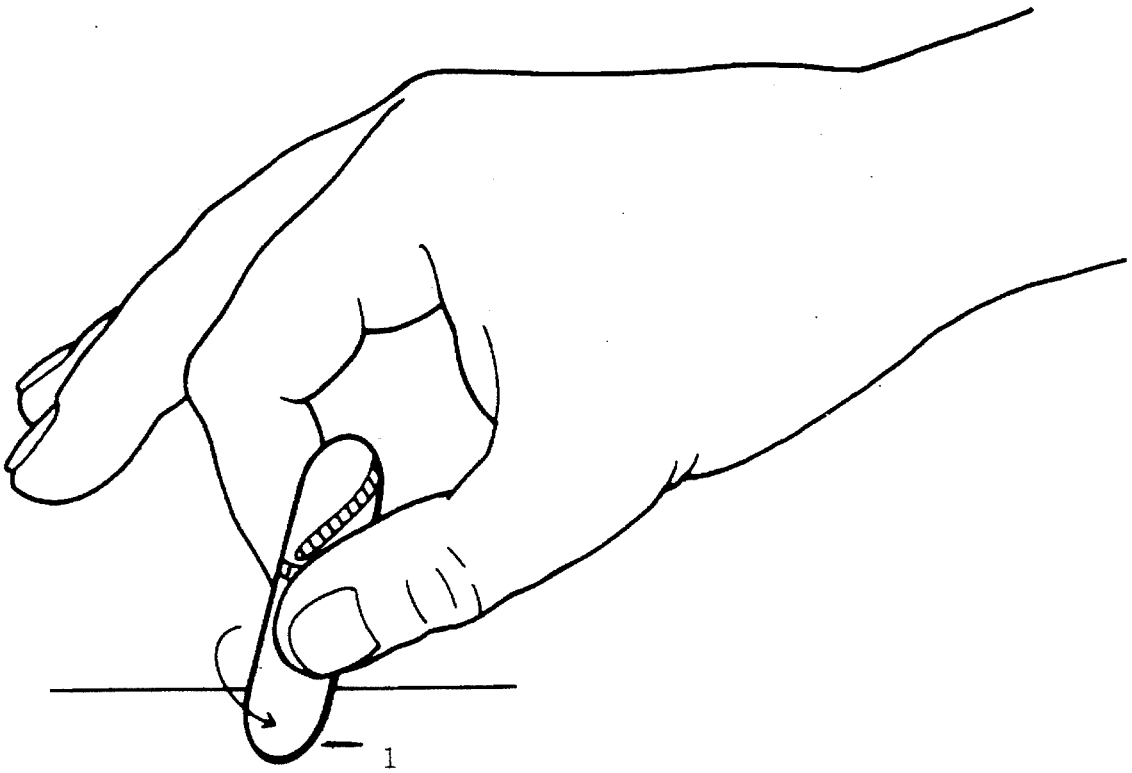
FIG. 2 shows a spinner being set in motion.

The typical embodiment of the present invention is illustrated in FIG. 1A (frontal view) and FIG. 1B (cross-sectional view). An area of green markings 10 and an area of pink markings 11 demonstrate an example of markings that may be used. The operation of the present invention is shown in FIG. 2, where the spinner 1 is placed between the thumb and index finger, with the design markings placed upward. With a finger snapping motion, the spinner is released. The finger snapping action causes the spinner to spin in a counter-clockwise direction while actually rotating in a clockwise direction. Spinning at an angle relative to a flat surface creates a wobbling effect as the spinner does not have the structure to spin upright as a top or gyroscope. The visual pattern is generated by the spinner moving in this fashion.

Figure 3A:
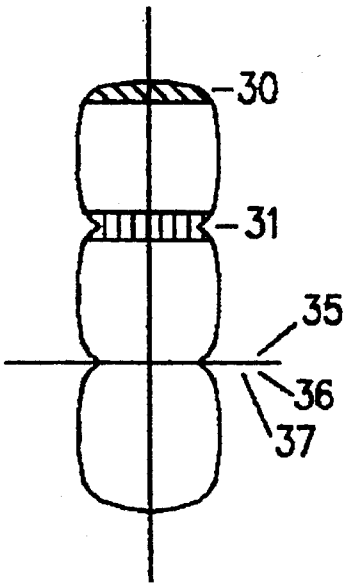
FIG. 3A shows a frontal view of an assembled spinner.
Figure 3B:
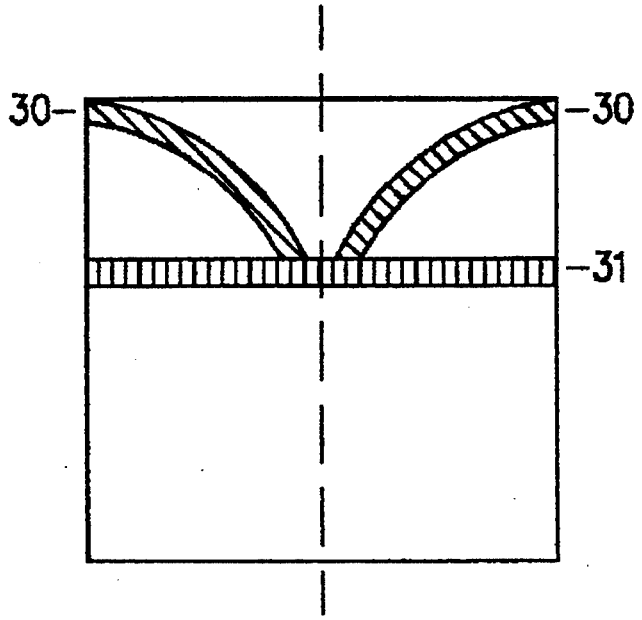
FIG. 3B shows a flattened out view of an exemplary set of markings on spinner of 3A.
Figure 3C:
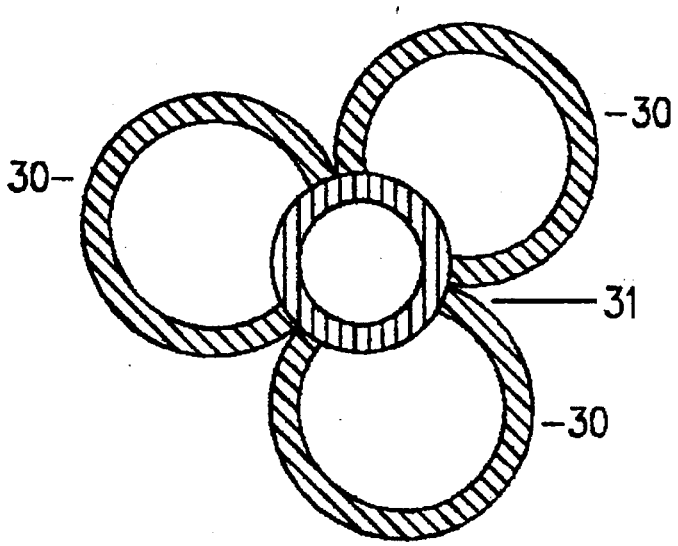
FIG. 3C shows the visual pattern generated by spinner of 3A.

FIG. 3A illustrates a frontal view of the present invention assembled from sectional pieces. An area of green markings 30 one pink markings 31 demonstrate an example of a set of markings that may be used. FIG. 3B illustrates a flattened view of the markings shown in FIG. 3A along side of the rod. FIG. 3C illustrates the visual pattern that is generated when the present invention is caused to spin rapidly. The visual pattern is a clear design depicting the green markings 30 and pink markings 31. This is an example of the many patterns possible with appropriate sets of markings.

Figure 4A:
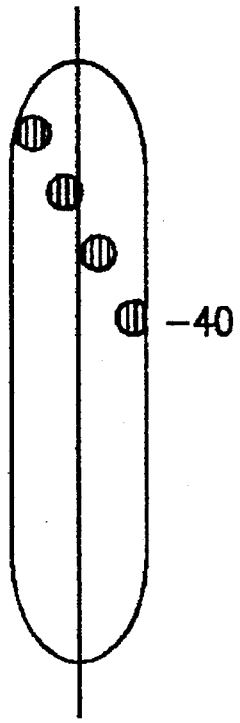
FIG. 4A shows a frontal view of spinner with another set of markings.
Figure 4B:
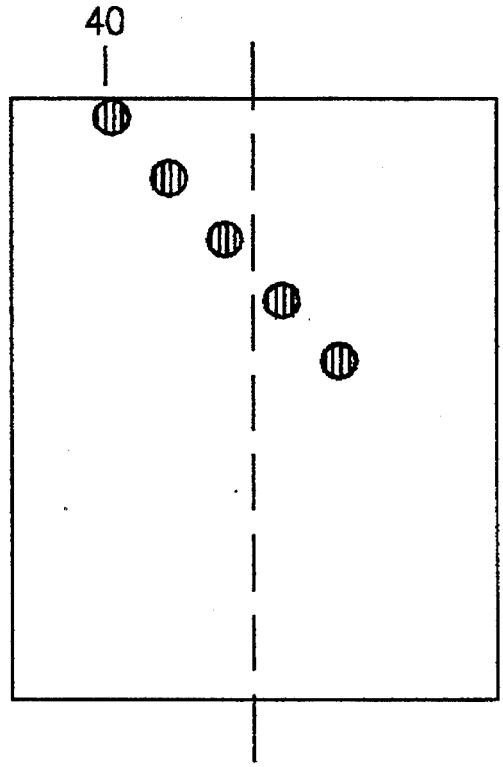
FIG. 4B shows a flattened out view of an example of a set of markings of 4A.
Figure 4C:
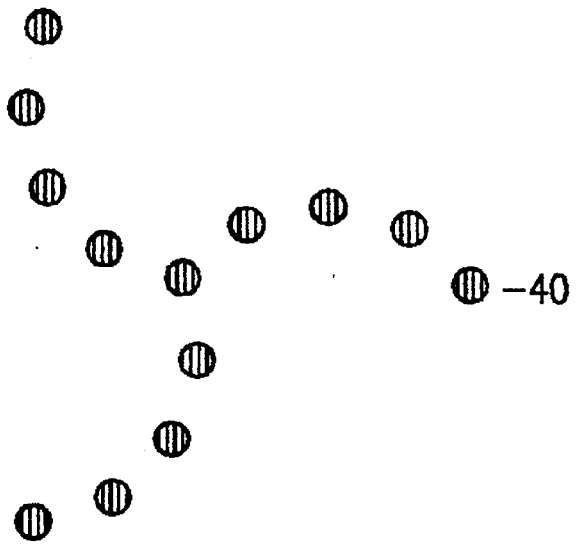
FIG. 4C shows the visual pattern generated by spinner of 4A.

FIG. 4A illustrates a frontal view of a one piece construction of the present invention. An area of green markings 40 demonstrate an example of a set of markings that may be used. FIG. 4B illustrates a flattened view of the set of markings demonstrated in FIG. 4A. FIG. 4C illustrates the visual pattern generated when the spinner is operated correctly. The visual pattern is a clear design depicting the green markings 40. This is another example of one of many patterns possible.

This toy may be made from a single rod with the ends rounded, the curved ends allowing for the intended wobbling motion better than a top's normally pointed tip. The toy may also be made of a hollow tube with at least one end rounded and closed to provide the end for wobbling. This toy may also be made from segments such as 35, 36, and 37 attached together by gluing or upon a central post to form a segmented rod.

The set of markings may comprise embedded colored material, embedded as seen in FIG. 1B. Further, a set of markings may be produced of paint. These markings may be a variety of pigments, but florescent pigments are suggested as these set of markings provide a more dramatic three-dimensional pattern when this toy is spun rapidly in a darkened room.

CONCLUSION, RAMIFICATIONS AND SCOPE

Accordingly, the reader will see that the ability of this invention to create sophisticated three-dimensional graphic designs by spinning a simple device is a feature that is unique in the toy arena. Furthermore, the toy offers the option of viewing the graphic designs in light or in darkness, by adding either florescent or luminescent markings in design patterns on the toy. Significant advantages of this invention also include the small amount of skill needed to create the graphic illusions, and the relatively low cost to manufacture, and therefore sell, this toy. Although the description above contains many specifications, these should not be construed as limiting the scope of the invention, but as merely providing illustrations of the presently preferred embodiments of this invention.

Thus the scope of the invention should be determined by the appended claims and their legal equivalents, rather than by the examples given.

I claim:

1. A spinning toy with markings to generate a visual pattern, the spinning toy consisting of a constant diameter elongated rod with markings and rounded ends, the rounded ends being rounded from the diameter, the marking comprising a luminous material pigment which may be exited to glow thereby emitting light, wherein the rod, when spun, wobbles on its rounded end around a vertical causing said markings to generate a three-dimensional pattern.

2. A spinning toy as in claim 2, where the markings are embedded into the rod.

3. A spinning toy as in claim 2, where the markings are painted upon the rod.

4. A spinning toy as in claim 1, where the rod is made of one of plastic, metal, wood and wax.

5. A spinning toy as in claim 4, where the rod is assembled from segments to make one piece.

6. A spinning toy with markings to generate a visual pattern, the spinning toy consisting of a constant diameter elongated tube with markings and rounded ends, the rounded ends being rounded from the diameter, the markings comprising a luminous material pigment which may be exited to glow thereby emitting light, wherein the tube, when spun, wobbles on its rounded end around a vertical causing said markings to generate a three-dimensional visual pattern.

7. A spinning toy as in claim 1, where the markings are embedded into the tube.

8. A spinning toy as in claim 1, where the markings are painted upon the tube.

9. A spinning toy as in claim 6, where the tube is made of one of plastic, metal, wood, and wax.

10. A spinning toy as in claim 9, there the tube is assembled from segments to make one piece.

* * * * *